United States Patent [19]

Williams

[11] Patent Number: 4,869,500

[45] Date of Patent: Sep. 26, 1989

[54] COMBINATION VENDING MACHINE AND AMUSEMENT GAME

[75] Inventor: Geoffrey A. Williams, Middleton, United Kingdom

[73] Assignee: Rodstock Leisure Limited, Wigna, United Kingdom

[21] Appl. No.: 158,282

[22] Filed: Feb. 18, 1988

[51] Int. Cl.[4] ..... A63F 9/00

[52] U.S. Cl. ..... 273/1 E; 273/85 G

[58] Field of Search ..... 273/1 E, 1 GG, 85 G, 273/138 A, DIG. 28, 313; 40/584

[56] References Cited

U.S. PATENT DOCUMENTS

| | | | |
|---|---|---|---|
| 2,044,320 | 6/1936 | Norris | 273/143 |
| 3,185,279 | 5/1965 | Spears | 273/138 A |
| 4,352,492 | 10/1982 | Smith | 273/DIG. 28 |
| 4,445,187 | 4/1984 | Best | 273/DIG. 28 |
| 4,454,670 | 6/1984 | Bachmann et al. | 40/584 |
| 4,636,951 | 1/1987 | Harlick | 273/138 A |

FOREIGN PATENT DOCUMENTS

| | | |
|---|---|---|
| 411262 | 6/1934 | United Kingdom . |
| 1338083 | 11/1973 | United Kingdom . |
| 1520739 | 8/1974 | United Kingdom . |
| 1416737 | 12/1975 | United Kingdom . |
| 1417865 | 12/1975 | United Kingdom . |
| 2023098 | 12/1979 | United Kingdom . |

*Primary Examiner*—Leo P. Picaro
*Assistant Examiner*—Jessica J. Harrison
*Attorney, Agent, or Firm*—Salter & Michaelson

[57] ABSTRACT

A vending machine (9) is combined with a separate or integral skill game machine (11) and the combination is arranged so that a user can choose to use the combination in a vend mode or in a playvend mode, in which latter mode the player pits his physical and/or mental skill against the skill machine and if successful is rewarded by a free or a reduced cost vend.

12 Claims, 2 Drawing Sheets

COMBINATION VENDING MACHINE AND AMUSEMENT GAME

This invention relates to a vending machine and it is an object of the present invention to provide a machine which offers an individual interest to vend customers to enhance machine utilisation to increase sales and profitability.

Accordingly the invention provides a vending machine incorporating or in combination with a skill game device and operable, at the user's choice, in a pure vend mode or in a playvend mode.

As used herein the term "skill game" means a game whose outcome is based wholly or mainly on at least one mental or physical skill of the user. A user who wins can receive a prize in cash or kind.

A won prize can be combined with a user's stake (a number of coins or tokens fed into the machine) to provide effectively a free vend or a reduced price vend.

As a mental skill a user can, in each play, be presented with a display pattern, as of lights and or numbers and be asked to calculate or estimate some relationship between the components of the display, or, in a moving changing display, predict the future content of the display.

As a physical skill the player can be invited to aim a projector at a target on a screen or the like, or can be invited to hit a button with a specified necessary degree of force.

In a mental skill game a player could be presented with a series of numbers and asked to predict, within a set time period, the next in the series. The skill here would be mental arithmetic.

In a specific physical skill game a plunger or button could be provided which needs to be tapped or hit with a desired degree of force to cause certain results. The result of a user tapping the plunger can be physically determined and displayed, but is desirably electronically simulated and displayed as a visual image or series of images.

The display can take place on a screen of a cathode ray tube forming part of the apparatus.

In this case, the game can be mental and/or physical requiring mental and/or physical skills to win.

Figure 1:
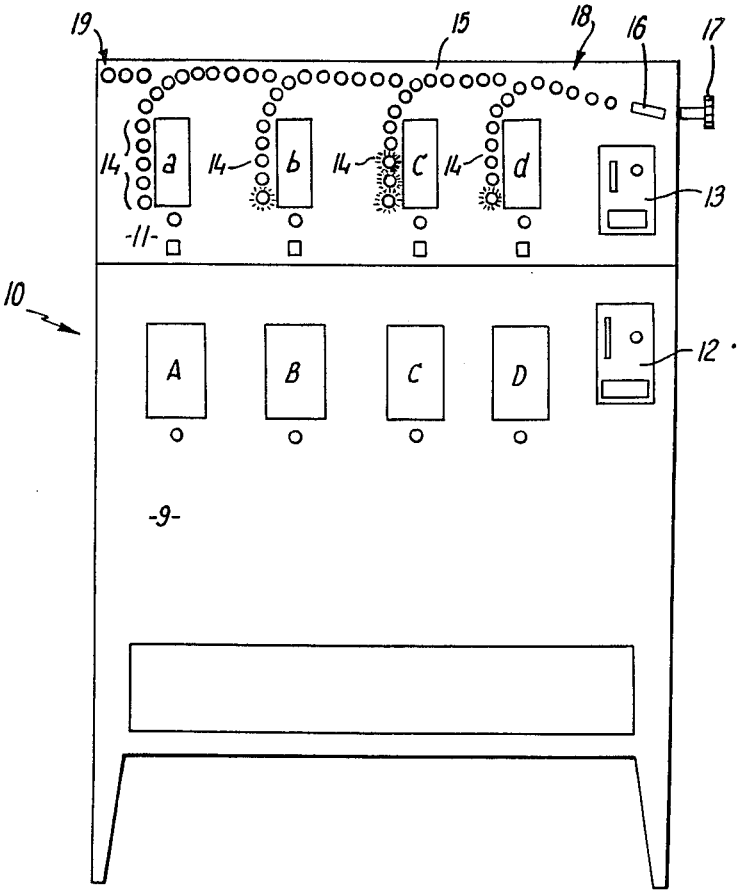
Figure 2:
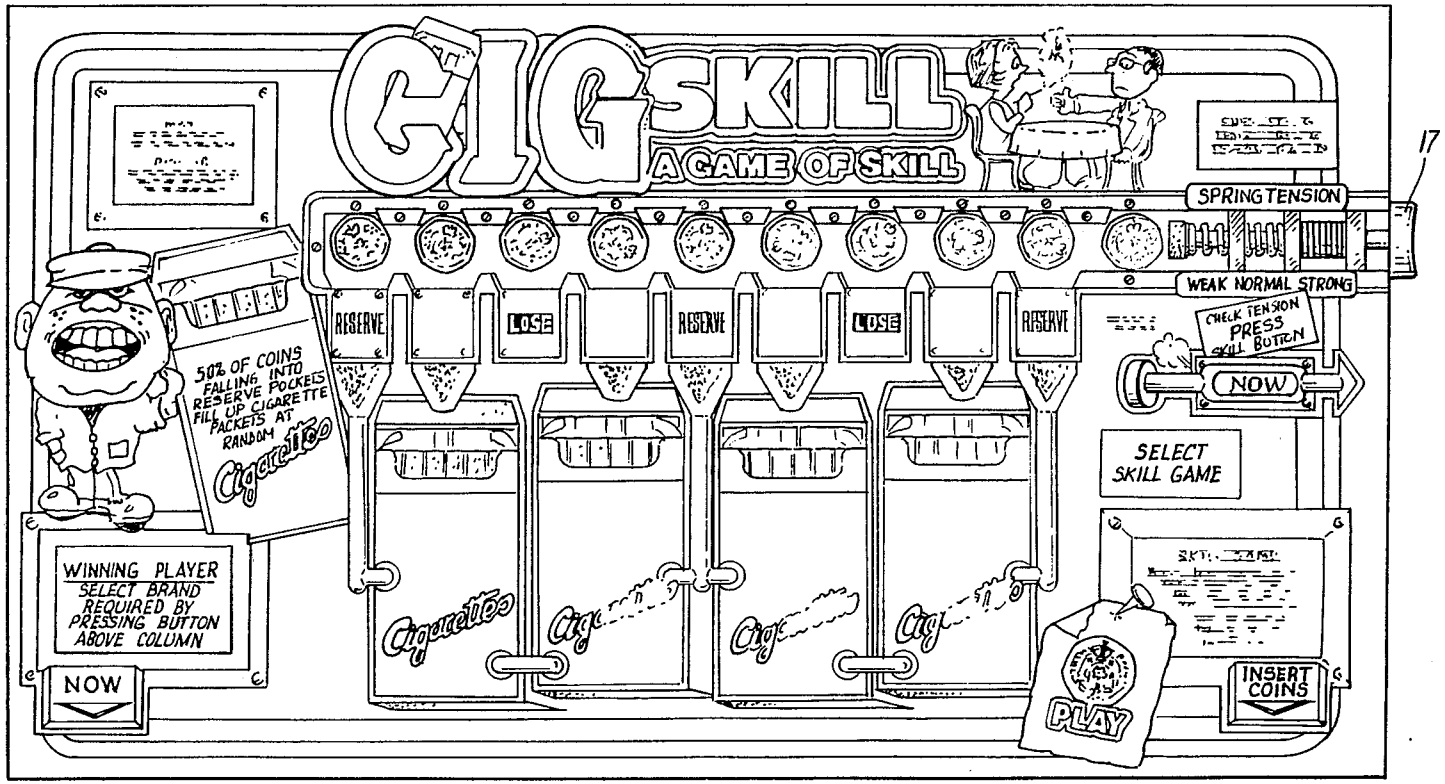

The invention will be described further, by way of example, with reference to the accompanying drawings, wherein:

FIG. 1 is a front elevation of a possible embodiment of machine of the invention; and FIG. 2 illustrates a practical form of a front facing screen for the machine of FIG. 1.

A preferred machine 10 of the invention has a vend part 9 and a game part 11. The parts 9 and 10 can be integral, or part 10 can be an additional item securable to an existing vending machine 9. Part 9 is an electrically controlled vending machine having, say, four products A-D and a coin introduction and checking mechanism 12. A user can use the machine 10 in a pure vend mode by inserting a coin or token group into mechanism 12 and selecting one of products A to D in a conventional manner.

If the user wishes to take the game option he must place his coin or token group into a comparable second mechanism 13. If desired, there can be a single coin receiving mechanism on either the vend part or the game part, means being provided to enable a player to select between the two modes play or vend.

Use of mechanism 13 primes the game device part 11 which have four targets denoted a–d and corresponding to vend products A–D. Each target is constituted by a column 14 of five lights depending from a main "trajectory" line of lights 15. The trajectory line 15 starts at a representation of a projector 16 adjacent an actuator plunger 17. The plunger 17 can be part of an assembly which is the subject of patent application GB2181065A, which details has the "plunger" or button 17 interfaces with circuitry of the display.

The various lights 14, 15 can be in the form of circles which when illuminated give the impression of a win. The mechanism 13, plunger 17 and the lights are connected to a CPU such as a programmed calculator or small computer which contains the "rules" and regulations of the game. The plunger 17 sends a different output to the CPU depending on how hard the plunger 17 is hit and the CPU is programmed to produce a series of illuminated lights along the various trajectory and target lines 15, 14 in simulation of the track of a "missile" projected from the "projector" 16 in the manner of a shell of a bagetelle ball. Thus a minimal actuation of plunger 17 will cause a series of lights to simulate a slow travelling "missile" reaching to point 18 or less, followed by a "roll back" to projector 16. A "roll-back" "ball" may be re-playable or may fall into a "lose" target (not shown). A plunger impact above a certain level will cause a fast traverse past all targets to a "lose" position 19. Intermediate weights or speeds of actuation of plunger 17 will cause a simulated trajectory ending in one of the target columns 14. The rate of light illumination can be programmed to simulate a missile's initial high speed and its slowing rise to maximum height due to the deceleration or "gravity" and its subsequent acceleration downwards under "gravity" to the target column. Each time a "missile" lands in a "target" to lowermost "off" light can remain illuminated to signal a "hit" on that "target". To win, a player must achieve a minimum number of "hits" on a selected "target".

As an example, if the vend price of an article is 1.00, the person wishing to try his skill may place 0.50 in the mechanism 13 and be given five attempts at "hitting" his selected "target". If he succeeds with all five attempts he may receive his selected vend item at a reduced price of 50 p. If he fails he may suffer a total loss, or he may receive a 10 p "credit" on his vend for each successful "hit", the balance of cash needing to be made up via mechanism 12 or by additional attempts at the "play" mode, or combination of the two.

Thus the user is presented with the opportunity of a pure vend or a game vend with a possibility of receiving a cheaper purchase with the added interest of the game. This should increase utilisation and increase the profits of the machine provider.

Naturally the nature and rules of the game can be varied widely. Mental and/or physical skills can be tested and various options can be presented to a player or user, for example, as to whether he wishes to play a physical or mental game, or a game using both skills.

A single mechanism 12, 13 could be provided illuminated panel(s) and button(s) inviting the user to play or buy.

The skill game machine can be a separate entity operatively connected to, but disconnectable from a vending machine. It is expected that the vending machine will need modification to allow the connection of the skill machine to it. A single machine including both the "vend" and "skill" parts can be constructed. However, in such a case, it is desirable that the skill part is such that the game played can be changed periodically as users become familiar with and uninterested in the game.

The skill game can be displayed on a cathode ray tube such as a monitor screen mounted in a separate skill machine part or forming part of a combined skill and vend machine. In this case the rules and operating parameters of the game can be held within memory connected to circuitry controlling the screen and within software controlling operation of the circuitry. In such a machine the game can be changed at will by changing the software, as by re-programming via an appropriate electric part. Variation in screen surround format or player directions from game to game can be achieved using removable screen overlays or the like.

A mental skill game can be of a quiz-like nature, the user having to press buttons or to otherwise indicate his selected answer. A tally of correct score can be kept and translated into vend credits electronically at the user's option. Many other types of game can be provided by appropriate software, for example noughts and crosses, a similar marker or piece-placing or moving games. However, it is felt that chess might take too long for the user's and the vendor's peace of mind!)

A game could be used which involved the user actuating a "weapon" by pressing a button rapidly in response to an occurrence on the screen. It could be argued that such a game is purely physical, but mental skills are probably also involved. There are many existing target skill games which can be used in the combination of the invention when display is by means of a monitor screen.

The vending part of the combination can vend cigarettes, sweets, drinks or any combination of all these goods or any other goods. The modification of a conventional vend machine to accept value credits transmitted electronically from a game part of the combination as well as from a conventional coin receiving mechanism is a simple task for a skilled engineer and is not described.

It will be appreciated that any prize awarded by the skill machine can be in cash or tokens, or can take the form of an article. For example, a prize on a skill machine accompanying a cigarette vending machine could be a packet of cigarettes, particularly a specific brand of cigarettes being promoted. A cathode ray tube screen has been mentioned. Such a screen can be replaced by a liquid crystal display or a light-emitting diode screen if desired.

Of course, many other variations from the above can be made within the scope of the following claims.

I claim:

1. A combination vending machine and amusement game comprising a vending portion, a game portion, and a credit portion, said vending portion including storage means for storing items to be vended and dispensing means for dispensing items to be vended from said storage means in response to receipt of a predetermined credit value from said credit portion, said game portion being actuated in response to receipt of a predetermined credit value from said credit portion and being manually operable for achieving and displaying winning or loosing game scores in order to generate corresponding positive or negative credit values, respectively, said game portion being further operative for displaying said game scores, said credit portion including means for receiving currency and for generating corresponding credit values and credit value storage means for receiving and storing credit values from said currency receiving means and said game portion, said credit value storage means being manually actuatable for selectively dispensing credit values to said game portion or said vending portion in order to actuate said game portion or to dispense items from said vending portion, respectively, and being operative for displaying a total value of stored credit.

2. In the combination of claim 1, said game portion being detachable from said vending portion and said credit portion.

3. In the combination of claim 1, said vending portion and said credit portion being independently operable without said game portion.

4. In the combination of claim 1, said means for receiving currency being operative for generating a credit value signal corresponding to the value of coins received, said credit value storage means including a memory for determining the total value of coins received and for comparing same with a vend price, said vending portion being operative for dispensing an article when said total value of coins received equals said vend price, said game portion being operative for generating positive or negative credit value signals corresponding to winning or loosing game scores, respectively, said memory receiving credit value signals from both said currency receiving means and said game portion and being operative for displaying th sum total of the credit value signals received from said currency receiving means and said game portion.

5. In the combination of claim 1, said game portion including a touch sensitive member.

6. In the combination of claim 1, said game portion including a target at which a user must aim in order to achieve a game score.

7. The combination of claim 1, including a cathode ray tube for displaying said total value of credit stored.

8. In the combination of claim 7, said cathode ray tube being operatively connected to said game portion, said game portion further comprising an actuator which is operatively connected to said cathode ray tube for interacting with a game program displayed thereon.

9. In the combination of claim 8, said game portion including a microprocessor which is operative for implementing a set of game rules.

10. In the combination of claim 9, said microprocessor having selector means operable for individually implementing a plurality of different game rules.

11. In the combination of claim 10, said microprocessor having a port for receiving additional game programs.

12. In the combination of claim 1, said credit value storage means also being manually actuatable for dispensing currency corresponding to stored credit values.

* * * * *